US006499900B1

(12) United States Patent
Brozell

(10) Patent No.: US 6,499,900 B1
(45) Date of Patent: Dec. 31, 2002

(54) DUAL LIQUID DISPENSING PACKAGES

(75) Inventor: Leonora M. Brozell, Maumee, OH (US)

(73) Assignee: Owens-Illinois Closure Inc., Toledo, OH (US)

( * ) Notice: Subject to any disclaimer, the term of this patent is extended or adjusted under 35 U.S.C. 154(b) by 0 days.

(21) Appl. No.: 09/981,544

(22) Filed: Oct. 16, 2001

(51) Int. Cl.[7] ..... B43K 5/06

(52) U.S. Cl. ..... 401/175; 401/47; 401/178; 222/137

(58) Field of Search ..... 401/47, 44, 65, 401/68, 78, 88, 171, 172, 173, 174, 175, 178, 179; 222/135, 137

(56) References Cited

U.S. PATENT DOCUMENTS

| | | | | | |
|---|---|---|---|---|---|
| 3,616,970 | A | | 11/1971 | Baumann et al. | |
| 4,029,236 | A | * | 6/1977 | Carson, Jr. et al. | 222/135 |
| 4,046,288 | A | | 9/1977 | Bergman | |
| 4,139,127 | A | | 2/1979 | Gentile | |
| 4,545,696 | A | | 10/1985 | Carluccio | |
| 4,664,547 | A | | 5/1987 | Rosenwinkel | |
| 4,865,231 | A | | 9/1989 | Wiercinski | |
| 5,025,960 | A | | 6/1991 | Seager | |
| 5,111,972 | A | * | 5/1992 | Sakurai et al. | 222/135 |
| 5,217,145 | A | | 6/1993 | Haan et al. | |
| 5,238,151 | A | | 8/1993 | Weinstein | |
| 5,320,259 | A | | 6/1994 | Weinstein | |
| 5,363,990 | A | | 11/1994 | Fillmore | |
| 5,372,285 | A | | 12/1994 | Harrold et al. | |
| 5,372,444 | A | | 12/1994 | Lhuisset | |
| 5,529,416 | A | | 6/1996 | Favre | |
| 5,570,821 | A | | 11/1996 | DeJonge | |
| 5,573,341 | A | | 11/1996 | Iaia | |
| 5,839,622 | A | | 11/1998 | Bicknell et al. | |
| 5,860,572 | A | | 1/1999 | Harrold et al. | |
| 5,992,705 | A | | 11/1999 | Lhuisset | |
| 6,030,138 | A | | 2/2000 | Losier | |
| 6,039,483 | A | | 3/2000 | Szekely | |
| 6,129,472 | A | * | 10/2000 | Thayer | 401/137 |
| 6,210,061 | B1 | | 4/2001 | Johnson | |
| 6,357,945 | B1 | * | 3/2002 | Losier et al. | 401/172 |

* cited by examiner

*Primary Examiner*—Robert M. Fetsuga
*Assistant Examiner*—Huyen Le

(57) ABSTRACT

A package for containing and dispensing a multiple-component liquid solution includes a product chamber member movably mounted within the sidewall of a canister, and defining at least first and second separate product chambers for containing liquids to be dispensed. First and second pistons are mounted in fixed positions within the canister and respectively slidably disposed within the first and second chambers. First and second passages extend from the respective pistons for feeding liquids displaced from the chambers through a manifold to a surface applicator mounted on the canister. Cooperating structure on the canister and the chamber member is manipulated by a user to move the chamber member within the canister over the pistons, and thereby to displace liquids from the chambers through the pistons to the manifold, in which the liquids are mixed and fed to the applicator.

48 Claims, 9 Drawing Sheets

DUAL LIQUID DISPENSING PACKAGES

The present invention is directed to packages for containing and dispensing multiple-component liquid solutions, such as a two-component deodorant, and to methods for making such packages.

BACKGROUND AND OBJECTS OF THE INVENTION

A general object of the present invention is to provide a package for containing and applying a multiple-component liquid solution, such as a two-component liquid deodorant, in which the liquid components are separated within the package and not mixed until the time of application, and in which the relative quantities of the liquids dispensed at each application are controlled by design of the package.

A package for containing and dispensing a multiple-component liquid solution in accordance with a first aspect of the present invention includes a product chamber member movably mounted within the sidewall of a canister, and defining at least first and second separate product chambers for containing liquids to be dispensed. First and second pistons are mounted in fixed positions within the canister and respectively slidably disposed within the first and second chambers. First and second passages extend from the respective pistons for feeding liquids displaced from the chambers through a manifold to a surface applicator mounted on the canister. Cooperating structure on the canister and the chamber member is manipulated by a user to move the chamber member within the canister over the pistons, and thereby to displace liquids from the chambers through the pistons to the manifold, in which the liquids are mixed and fed to the applicator.

A package for containing and dispensing a two-component liquid solution in accordance with one presently preferred embodiment of the invention includes a surface applicator mounted over the open end of a canister. An integrally formed product chamber member is movably mounted within the sidewall of the canister, and includes an internally threaded collar and first and second product chambers for containing liquids to be dispensed. A manifold is coupled to the applicator within the canister. The manifold has an outlet coupled to the applicator and a pair of spaced parallel inlets. First and second hollow pistons are suspended from the manifold inlets and respectively slidably disposed within the first and second chambers. A screw has an externally threaded shaft received within the collar and a circular base rotatably supported within the canister. Rotation of the screw within the canister moves the chamber member over the pistons and displaces liquids from the chambers through the pistons and the manifold to the applicator. In the disclosed embodiment, the screw is rotated by a pushbutton mounted within the canister and manipulable by a user from externally of the canister. Alternatively, the periphery of the screw may be accessible to a user through a suitable opening in the canister sidewall.

A package for containing and dispensing a two-component liquid solution in accordance with another preferred embodiment of the invention includes a canister and a surface applicator mounted over end open end of the canister. An integrally formed product chamber member is movably mounted within the sidewall of the canister, and includes a gear rack and first and second product chambers for containing liquids to be dispensed. A manifold is coupled to the applicator within the canister, and has a pair of spaced parallel inlets. First and second hollow pistons are suspended from the manifold inlets and respectively slidably disposed within the first and second chambers. A gear wheel is rotatably mounted on the canister sidewall in engagement with the rack for manipulation by a user to move the chamber member over the pistons and thereby displace liquids from the chambers through the pistons to the applicator.

A method of making a package for containing and dispensing a multiple-component liquid solution in accordance with another aspect of the invention includes providing a canister having an open end and a sidewall. An integrally formed product chamber member is mounted within the canister, and has at least first and second product chambers and a first element for moving the member with respect to the canister sidewall. A second element is mounted within the canister for engagement with the first element and manipulation by a user to move the product chamber member within the canister. First and second hollow pistons are suspended from a surface applicator. The first and second chambers are filled with first and second liquids to be dispensed, and the surface applicator is assembled over the open end of the canister such that the first and second pistons are respectively disposed in the first and second chambers.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

Figure 1:
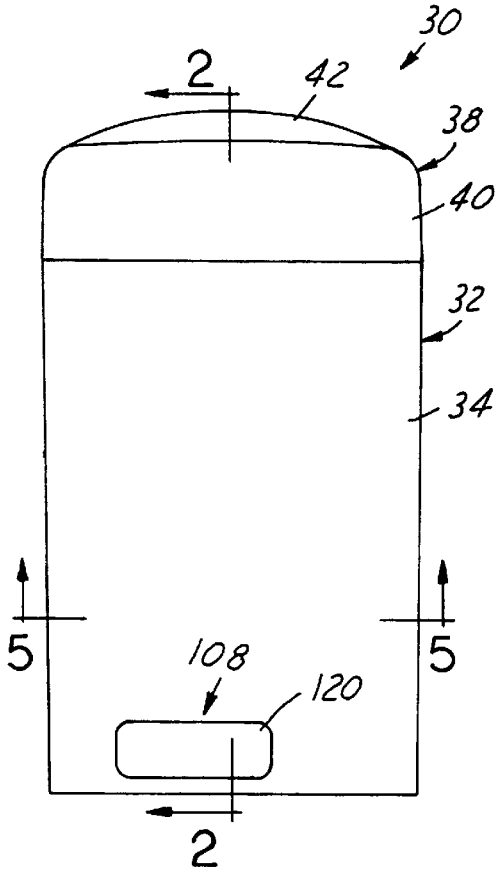
FIG. 1 is a front elevational view of a dual liquid dispensing package in accordance with one presently preferred embodiment of the invention.
Figure 2:
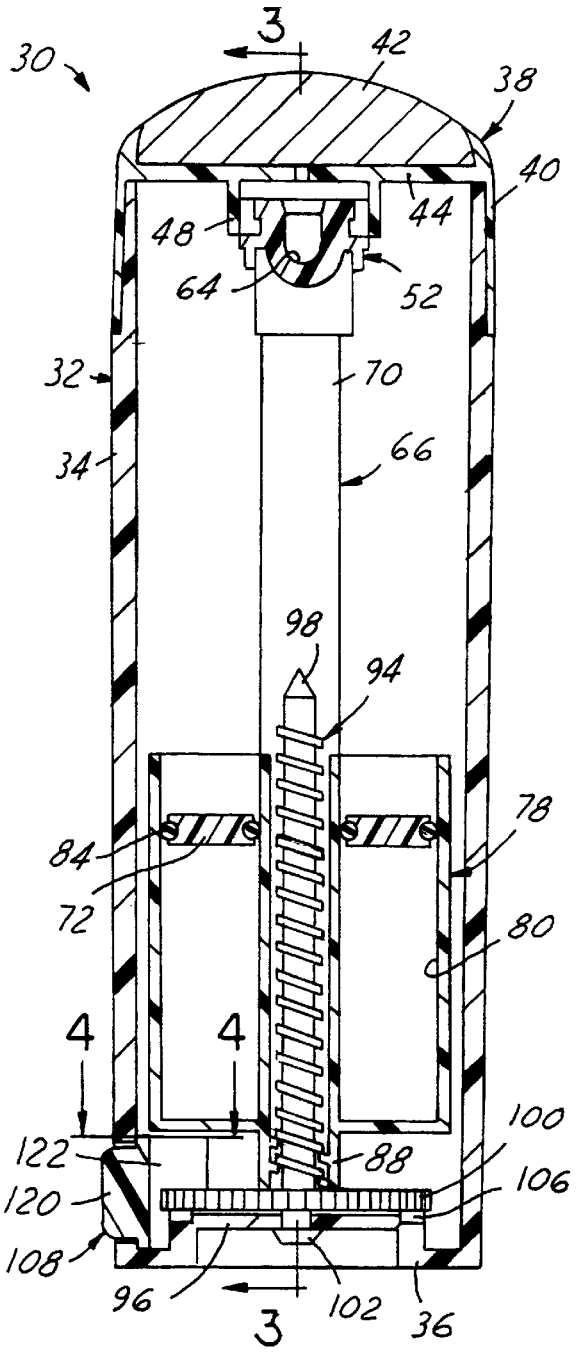
FIG. 2 is a sectional view laterally bisecting the package of FIG. 1, being taken substantially along the line 2—2 in FIG. 1.

FIGS. 1–17 illustrate a package 30 in accordance with one presently preferred embodiment of the invention. A hollow cup-shaped housing or canister 32 includes a sidewall 34, a bottom wall 36 and an open upper end. (It will be appreciated that directional adjectives such as "upper" and "lower" are used by way of description and not limitation with respect to the upright orientation of the package illustrated in FIGS. 1–3.) A surface applicator 38 is secured over the open end of canister sidewall 34. Applicator 38 includes an applicator holder 40 and an applicator body 42. Holder 40 (FIGS. 2–3 and 14–15) is of inverted cup-shaped construction, having an upper base wall 44 and a peripheral skirt externally secured over the upper end of canister sidewall 34. The external surface of base wall 44 has a plurality of ribs 46 (FIG. 14) forming channels or grooves between the ribs to dispense liquid product throughout the upper surface of the applicator holder. The underside of base wall 44 has an annular wall 48 that surrounds an outlet opening 54 that extends through wall 44, and opposed part-circular walls 50.

Figure 3:
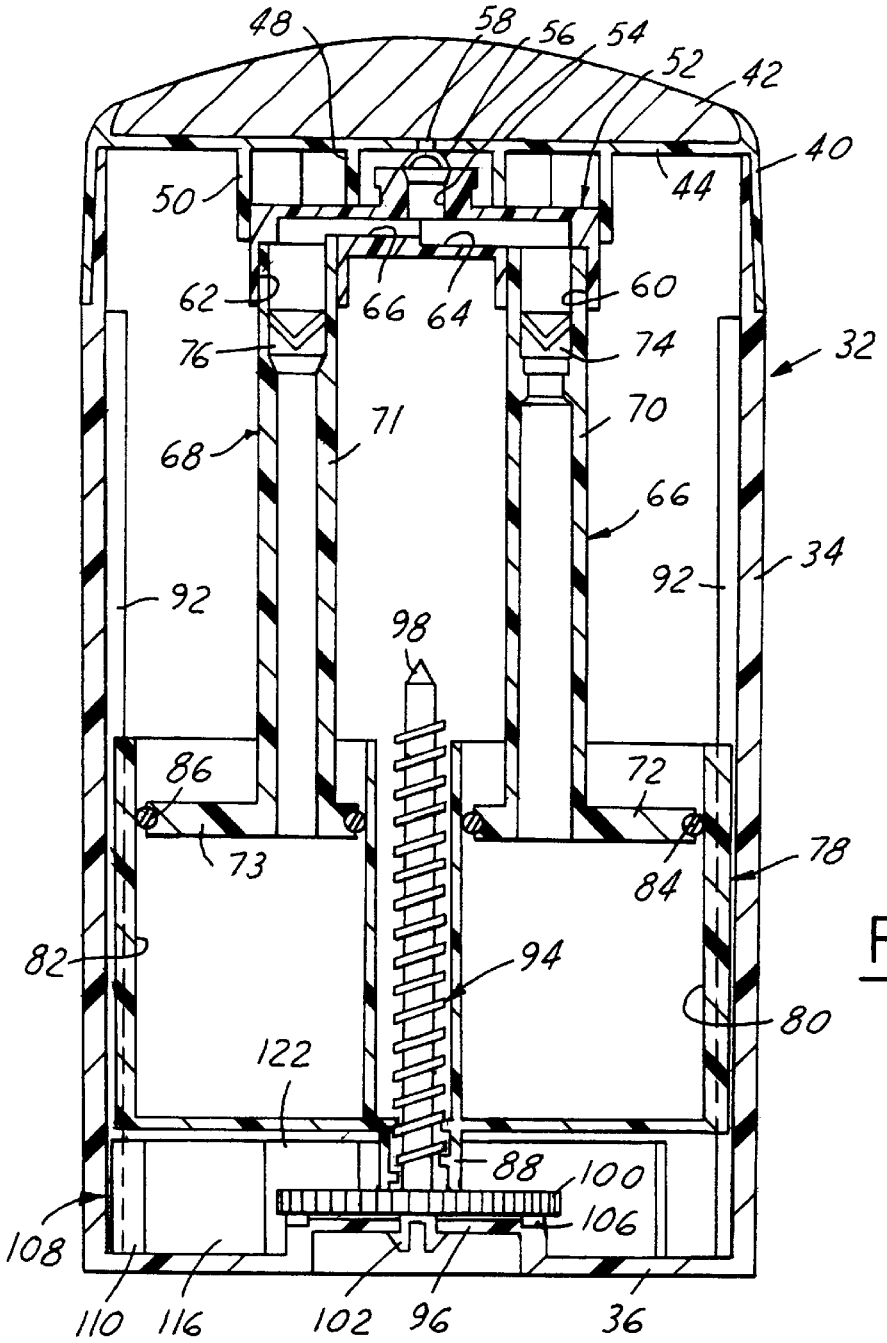
FIG. 3 is a sectional view bisecting the package of FIG. 2, being taken substantially along the line 3—3 in FIG. 2.

A manifold 52 (FIGS. 2–3 and 17) is internally secured to the underside of applicator holder base wall 44 between walls 50 against wall 48, and is thereby suspended in assembly from the underside of the applicator. Manifold 52 is of inverted goalpost-shaped construction, having an upper outlet 54 that communicates through a check valve 56 within opening 58 in applicator holder 40, and parallel downwardly oriented cylindrical inlet openings 60, 62. Passages 64, 66 (FIG. 3) within manifold 52 connect the inlet openings to the outlet opening, at which the liquid products mix prior to delivery to the applicator. A first piston 66 (FIGS. 2–3 and 10–11) is suspended from manifold inlet 60, and a second piston 68 is suspended from manifold inlet 62. Pistons 66, 68 are hollow pistons, each having an associated hollow longitudinally extending passage 70, 71 and a transversely oriented piston head 72, 73. Pistons 66, 68 are thus suspended from inlets 60, 62 of manifold 52. A check valve 74, 76 is disposed within the passages of pistons 66, 68 respectively to prevent reverse flow of mixed fluid to the product chambers. Piston heads 72, 73 are preferably disposed in a common plane in assembly, as best seen in FIG. 3. Passages 70, 71 are parallel to each other.

Figure 8:
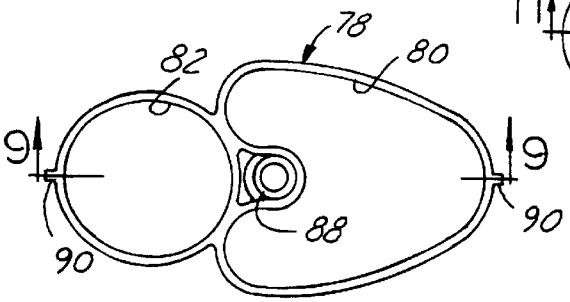
FIG. 8 is a top plan view of the product chamber member in the package of FIGS. 1–5.
Figure 10:
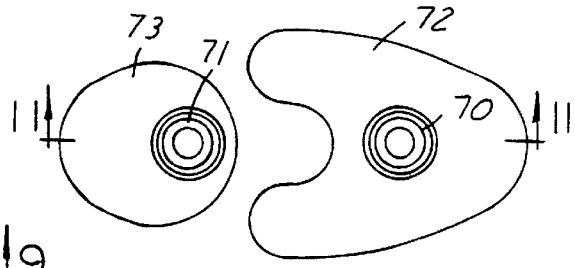
FIG. 10 is a top plan view of the pistons in the package of FIGS. 1–5.
Figure 9:
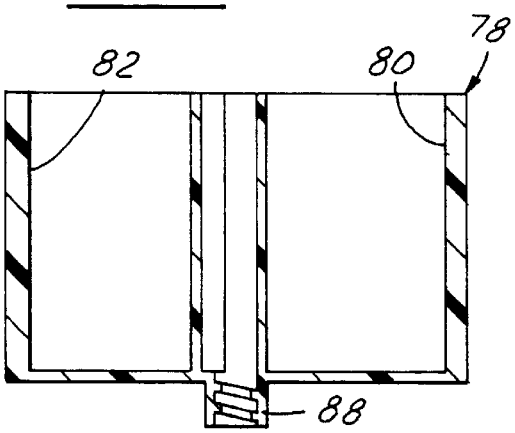
FIG. 9 is a sectional view laterally bisecting the chamber member of FIG. 8, being taken substantially along the line 9—9 of FIG. 8.
Figure 11:
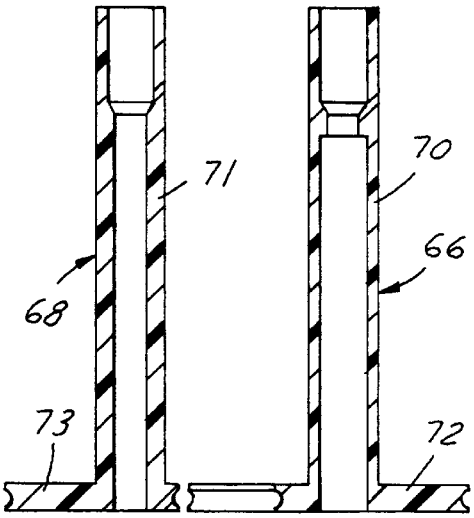
FIG. 11 is sectional view laterally bisecting the pistons of FIG. 10, being taken substantially along the line 11—11 in FIG. 10.

A product chamber member 78 (FIGS. 2–3, 5 and 8–9) is slidably mounted within sidewall 34 of canister 32. Chamber member 78 is preferably a one-piece body of integrally molded plastic construction, including a pair of product chambers 80, 82. Each product chamber 80, 82 is cup-shaped, having open upper ends disposed adjacent to each other in a common plane transverse to the longitudinal dimension of the canister. In the illustrated embodiment of the invention, and as best seen in FIG. 8, chambers 80, 82 are non-cylindrical in geometry, chamber 80 being significantly larger than chamber 82 and generally V-shaped as viewed from above. Piston heads 72, 73 are correspondingly shaped, as best seen by comparing FIG. 10 to FIG. 8. An O-ring 84, 86 extends around the peripheries of piston heads 72, 73 in sliding sealing engagement with the internal wall surfaces of chambers 80, 82 respectively. Chamber member 78 also includes an internally threaded collar or sleeve 88, disposed between chambers 80, 82. Sleeve 88 is so disposed on chamber member 78 as to coincide with the axial centerline of canister 32, for reasons to be described. An external rib 90 extends longitudinally along each side of chamber member 78, and is slidably captured between a pair of parallel internal ribs that form an inwardly opening axially extending slot 92 on each side of canister sidewall 34. Ribs 90 and slots 92 thus guide movement of chamber member 78 within canister 32. Ribs 90 and slots 92 are preferably disposed in a common plane that includes the axial centerline of the canister.

Figure 4:
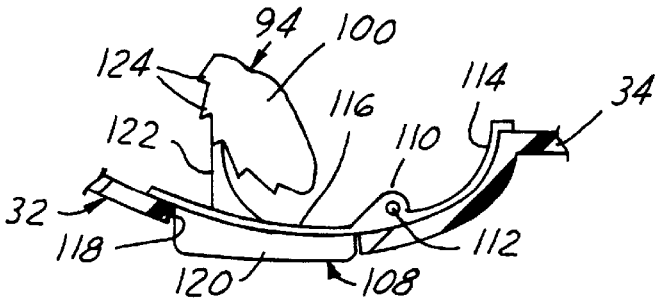
FIG. 4 is a fragmentary sectional view taken substantially along the line 4—4 in FIG. 2.
Figure 5:
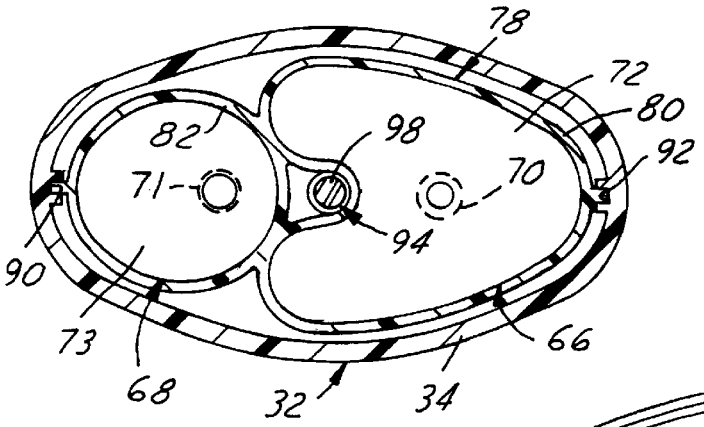
FIG. 5 is a sectional view taken substantially along the line 5—5 in FIG. 1.
Figure 6:
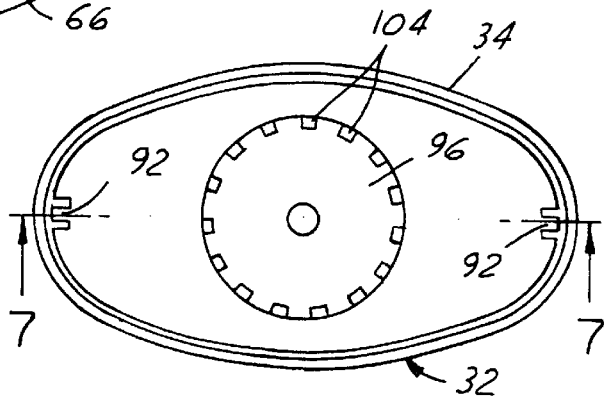
FIG. 6 is a top plan view of the canister in the package of FIGS. 1–5.
Figure 7:
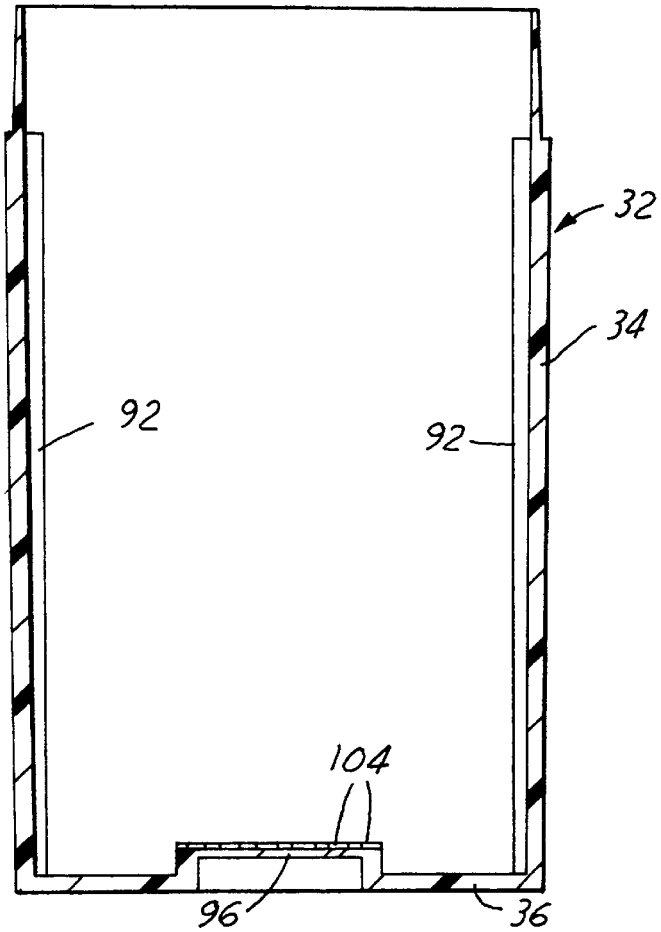
FIG. 7 is a sectional view bisecting the canister of FIG. 6, being taken substantially along the line 7—7 in FIG. 6.
Figure 12:
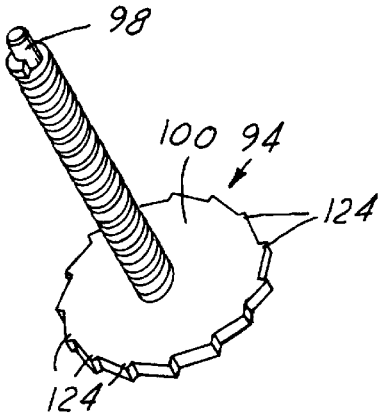
FIG. 12 is a top perspective view of the screw for raising the chamber member and dispensing liquid in the package of FIGS. 1–5.
Figure 13:
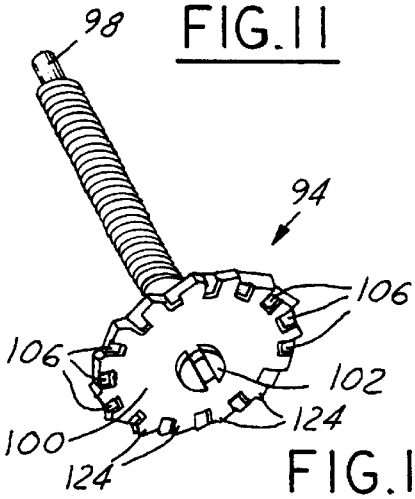
FIG. 13 is a bottom perspective view of the screw illustrated in FIG. 12.
Figure 14:
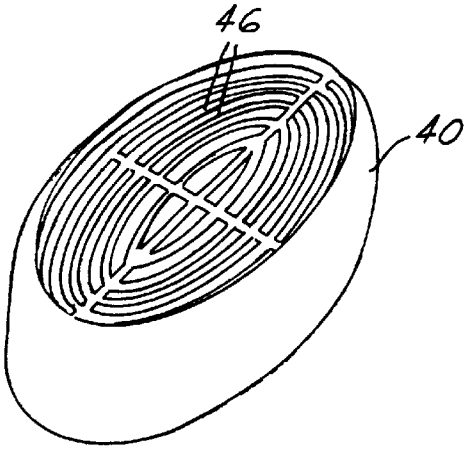
FIG. 14 is a top perspective view of the surface applicator base in the package of FIGS. 1–5.
Figure 15:
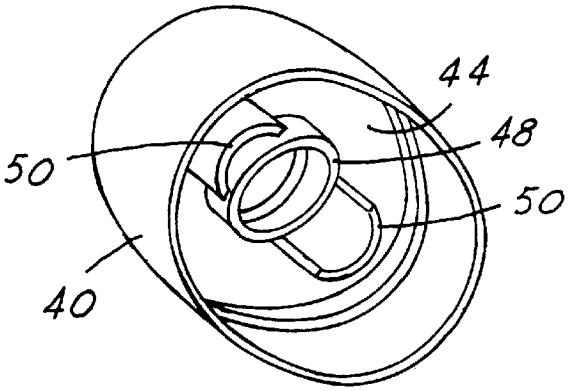
FIG. 15 is a bottom perspective view of the applicator base illustrated in FIG. 14.
Figure 16:
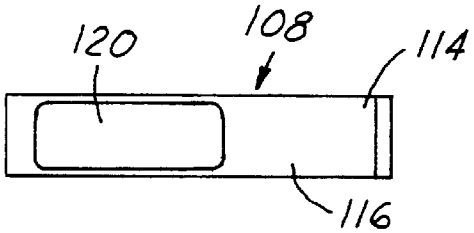
FIG. 16 is an elevational view of the dispensing button in the package of FIGS. 1–5.
Figure 17:
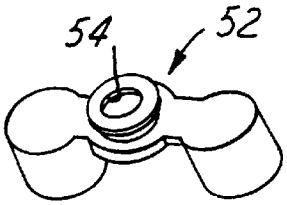
FIG. 17 is a top perspective view of the manifold in the package of FIGS. 1–5.
Figure 19:
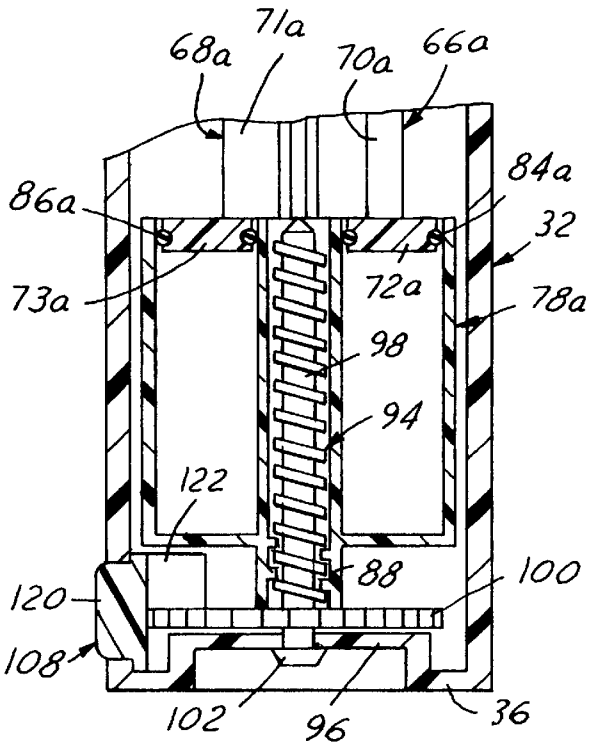
FIG. 19 is a fragmentary sectional view similar to that of FIG. 2 but illustrating the embodiment of FIG. 18.
Figure 18:
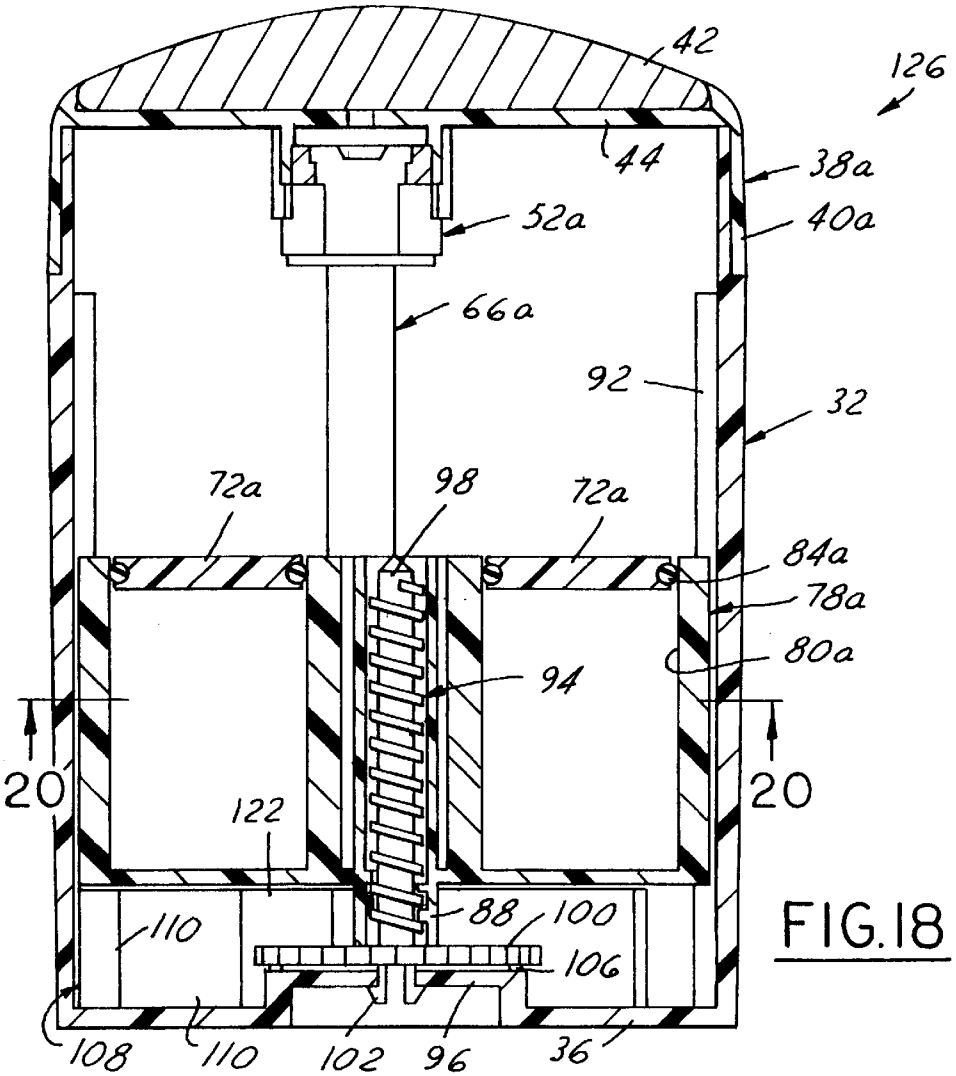
FIG. 18 is a sectional view similar to that of FIG. 3 but illustrating a modified embodiment of the invention.
Figure 20:
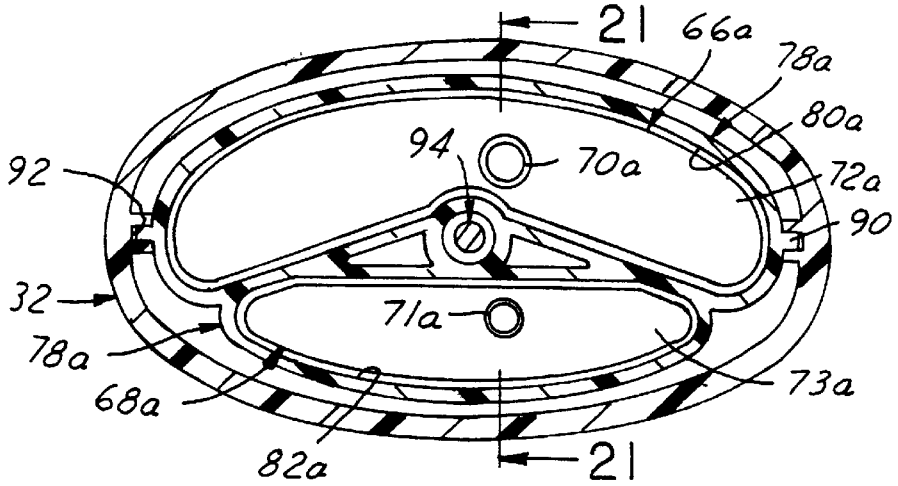
FIG. 20 is a sectional view taken substantially along the line 20—20 in FIG. 18.
Figure 21:
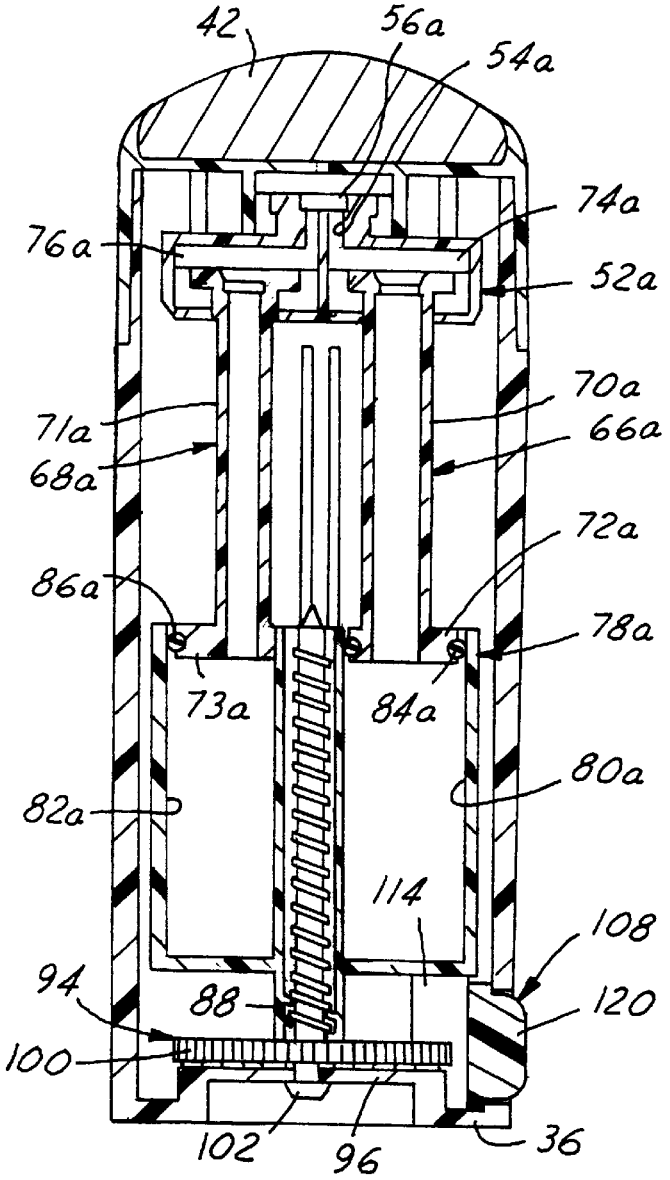
FIG. 21 is a sectional view taken substantially along the line 21—21 in FIG. 20.
Figure 22:
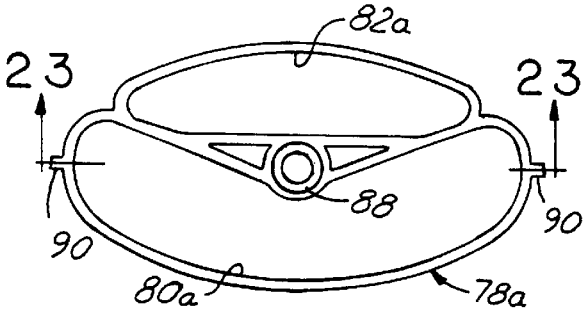
FIG. 22 is a top plan view of the chamber member in the package of FIGS. 18–21.
Figure 24:
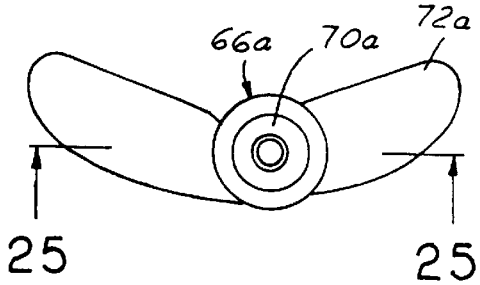
FIG. 24 is a top plan view of one of the pistons in the package of FIGS. 18–21.
Figure 23:
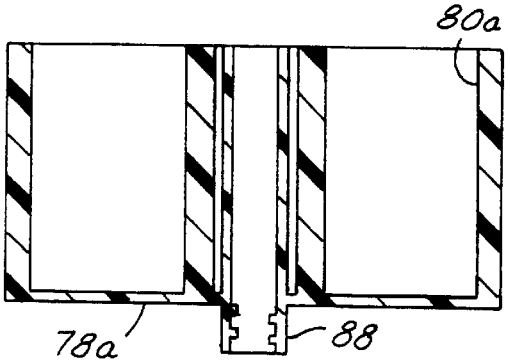
FIG. 23 is a sectional view taken substantially along the line 23—23 in FIG. 22.
Figure 25:
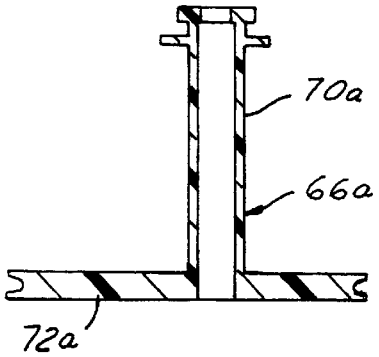
FIG. 25 is a sectional view taken substantially along the line 25—25 in FIG. 24.
Figure 26:
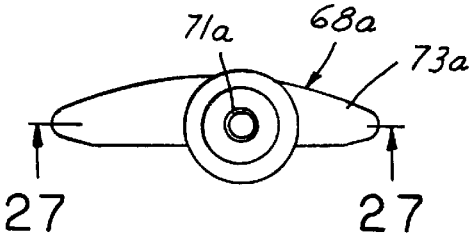
FIG. 26 is a top plan view of the second piston in the package of FIGS. 18–21.
Figure 27:
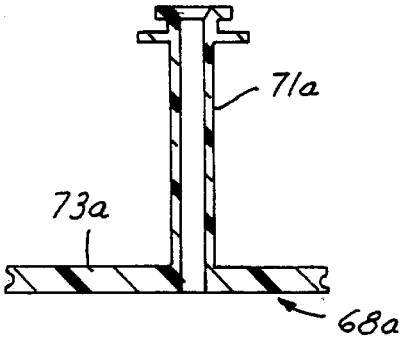
FIG. 27 is a sectional view taken substantially along the line 27—27 in FIG. 26.

A screw 94 (FIGS. 2–5 and 12–13) is carried by a pedestal 96 that is upwardly recessed with respect to bottom wall 36 of canister 32. Screw 94 has an externally threaded shaft 98 that centrally and coaxially projects from a circular base 100. Externally threaded shaft 98 is threadably received within internally threaded collar 88 of chamber member 78. Base 100 is loosely secured to pedestal 96 by means of a split lug 102 that extends from base 100 through a central opening in pedestal 96 rotatably to secure the screw to the base while permitting free rotation of the screw with respect to the base. The upper surface of pedestal 96 within canister 32 is provided with a plurality of ramped lugs 104 (FIGS. 6 and 7) disposed in a spaced circumferential array around the periphery of the pedestal. Likewise, the under surface of screw base 100 is provided with a spaced circumferential array of ramped peripheral lugs 106 (FIG. 13). Lugs 104, 106 are constructed with respect to each other to permit rotation of screw 94 in one direction to raise chamber element 78 within canister 32, but to prevent rotation of screw 94 in the other direction that would lower chamber element 78 within canister 32. An arcuate button 108 (FIGS. 1–4 and 16) has an apertured center 110 received over a pin 112 that extends upwardly from base 36 of canister 32 adjacent to canister sidewall 34. One leg 114 of button 108 extends along the inside surface of canister sidewall 34. A second leg 116 extends along the inside canister surface across an opening 118 in the canister sidewall. A button head 120 is integral with button 108 and projects through sidewall opening 118. A pawl arm 122 extends radially inwardly from leg 116 opposite head 120. The inner end of pawl arm 122 engages a circumferential array of rachet teeth 124 that extends around the periphery of screw base 100 (FIGS. 4 and 12–13).

In assembly, button 108 is secured within canister 32 and screw 94 is secured to chamber element 78. The chamber element and screw subassembly is then inserted into canister 32 so that split lug 102 extends through pedestal 96. Chambers 80, 82 may then be filled with liquids to be dispensed. In the meantime, applicator body 42 is secured to applicator holder 40, and manifold 52 and pistons 66, 68 are suspended from the underside of the manifold. Applicator 38 is then assembled over the open upper end of canister 32 with piston heads 72, 73 disposed within chambers 80, 82. When button 108 is resiliently pivoted radially inwardly by a user, screw 94 is rotated to move chamber element 78 upwardly over pistons 66, 68. Such movement displaces liquid product from within chambers 80, 82 through piston passages 70 into manifold 52, and thence through manifold outlet 54 and valve 56 to surface applicator 38. Each depression of button 108 dispenses an incremental amount of each liquid. When the button is released, the geometry and resiliency of button leg 114 return the button to the position of FIG. 4. However, screw 94 is prevented from rotating with the movement of button by one-way cam lugs 104, 106 on pedestal 96 and screw base 100.

It will be noted in the illustrated embodiment of FIGS. 1–17 that chamber 80 is substantially larger than chamber 82, and piston head 72 is correspondingly larger than piston head 73. Passage 70 through piston 66 is larger than passage 71 through piston 68, and manifold passage 64 is larger than manifold passage 66. Thus, the liquid chambers and passages are designed such that, for each depression of button 108, more liquid is displaced from chamber 80 than is displaced from chamber 82, and consequently more liquid from chamber 80 than chamber 82 is dispensed to applicator body 42. In this way, the relative dosages of the liquids are designed into the dispensing package. If it is desired that the liquids should be dispensed in equal dosages, chambers 80, 82 would be of the same size, as would the liquid passages through pistons 66, 68 and manifold 52. As noted above, chamber member 78, including chamber 80, 82, collar 88 and ribs 90, is of integrally molded plastic construction. Likewise, canister 32, applicator holder 40, screw 94, button 108, manifold 52 and pistons 66, 68 are of respective integrally molded plastic construction. Surface applicator body 42 may be of suitable foam or sintered plastic construction.

FIGS. 18–27 illustrate a package 126 that is a modification of that illustrated in FIGS. 1–17. Reference numerals in FIGS. 18–27 (and 28–29) that are identical to those employed in FIGS. 1–17 indicate identical components, while reference numerals followed by the suffix "a" (or "b" in FIGS. 28–29) indicate related but modified components. The primary difference between the embodiment of FIGS. 1–17 on the one hand and the embodiment of FIGS. 18–27 on the other is that the chamber member **78*a* has chambers 80*a* and 82*a* that are elongated with respect to the long dimension of the oval cross section of the package. That is, larger chamber 80*a* is again generally V-shaped, but this time the width of the V-shape extends in the direction of the long dimension of the oval container body rather than the short dimension as illustrated in FIG. 8. Likewise, smaller chamber 82*a* has a long dimension parallel to the long dimension of the container body. Pistons 66*a* and 68*a* are dimensioned and contoured in correspondence with the contours of chambers 80*a*, 82*a*** respectively.

Figure 28:
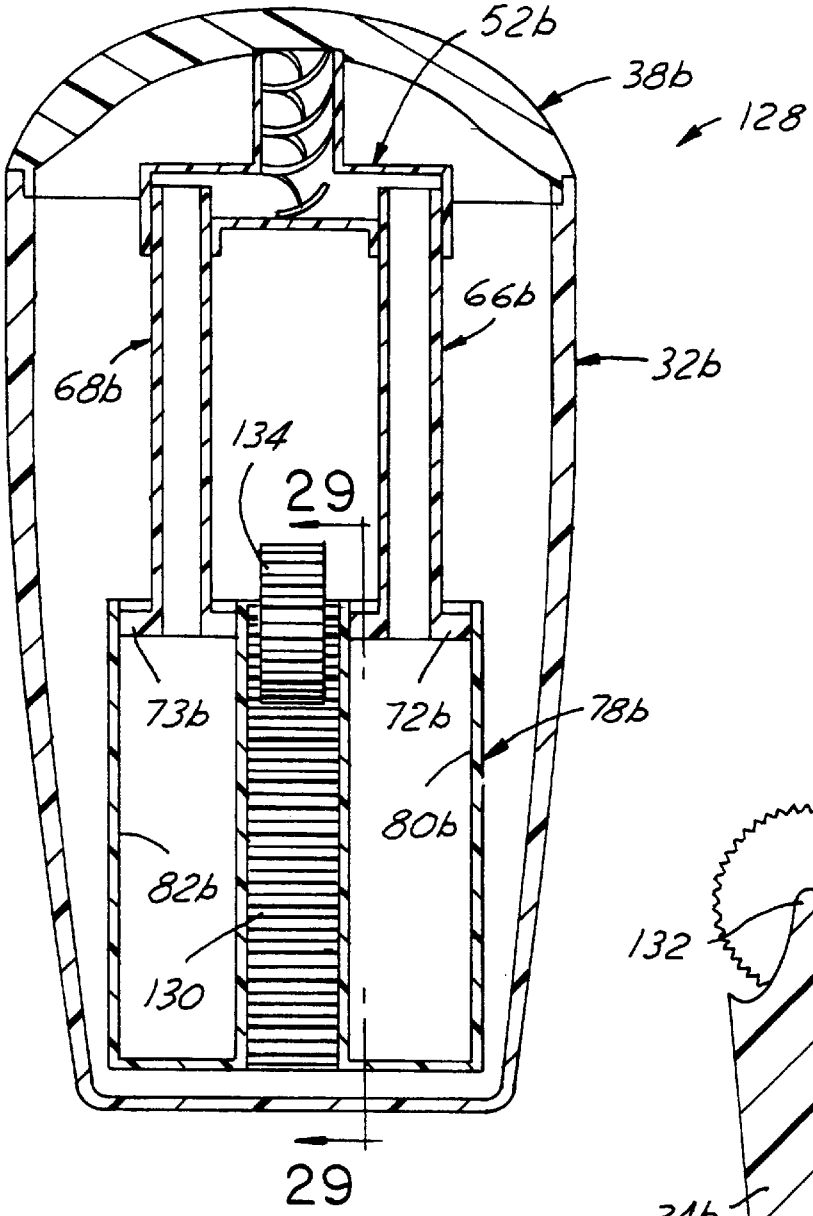
FIG. 28 is a sectional view laterally bisecting a dual liquid dispensing package in accordance with another embodiment of the invention.
Figure 29:
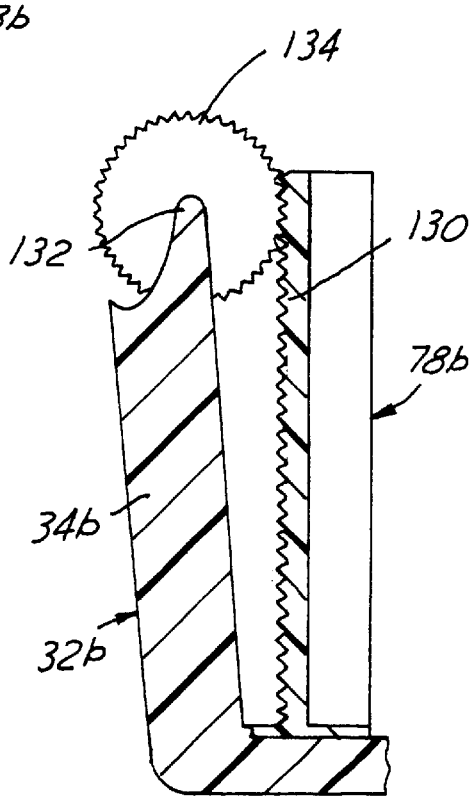
FIG. 29 is a fragmentary sectional view taken substantially along the line 29—29 in FIG. 28.

FIGS. 28 and 29 illustrate a dual liquid dispensing package 128 in accordance with another embodiment of the invention. An applicator **38*b* is received over the open end of a cup-shaped canister 32*b*. A manifold 52*b* is suspended from the inside of applicator 38*b*, and a pair of hollow pistons 66*b*, 68*b* are suspended from the parallel inlet openings of manifold 52*b*. Pistons 66*b*, 68*b* have heads 72*b*, 73*b* slidably disposed in respective chambers 80*b*, 82*b* in a product chamber member 78*b*. Product chamber member 78*b* is again of unitary integrally molded plastic construction, and in this embodiment includes a gear rack 130 extending along one side of chamber member 78*b* in a direction parallel to the direction of movement of the chamber member. Gear rack 130 is disposed internally adjacent to the sidewall 34*b* of canister 32*b*. Sidewall 34*b* has an opening 132 in which a gear wheel 134 is rotatably mounted. Gear wheel 134 has a circumferential array of external gear teeth that, within canister 32*b*, are in meshed engagement with rack 130 of chamber member 78*b*, and externally of canister 32*b* are disposed for manual manipulation by a user. Upon rotation of gear wheel 134 counterclockwise in FIG. 29, product chamber member 78*b* is moved upwardly over pistons 66*b*, 68*b*. Such movement displaces liquid within chambers 80*b*, 82*b* through the hollow pistons and through manifold 52*b* to applicator 38*b***.

There have thus been disclosed a package for containing and applying a multiple-component liquid solution, and a method of assembling such a package, that fully satisfy all of the objects and aims previously set forth. The invention has been disclosed in conjunction with presently preferred embodiments thereof, and a number of modifications and variations have been discussed. Other modifications and variations will readily suggest themselves to persons of ordinary skill in the art. For example, the chamber sizes and cross sections laterally of the direction of chamber element movement may be sized to achieve a desired liquid dispensing ratio. The embodiments of FIGS. 1–27 include button-activation of the chamber element lifting screw; however, the screw base could be of larger diameter and extend through slots in the canister sidewall for direct manual rotation of the screw. In the embodiment of FIGS. 28–29, the canister sidewall can be provided with a pawl or other suitable device for permitting rotation of gear wheel 34 in only one direction (counterclockwise in FIG. 29). A liquid solution of more than two components may be dispensed by providing additional chambers and pistons mounted to the manifold. The packages may be made refillable by mounting the screw or gear and the chamber element on a removable lower section of the canister. The illustrated embodiments employ O-rings 84,86, etc. as seals between the pistons and the chamber walls. In a production environment, seals may be integrally formed on the peripheries of the pistons to reduce part and assembly costs. It will also be recognized that the packages illustrated in the drawings would normally be marketed with a suitable cover that encloses the applicator during storage and transport, and between times of use by the user. The invention is intended to embrace all such and other modifications and variations as fall within the spirit and broad scope of the appended claims.

What is claimed is:

1. A package for containing and dispensing a multiple-component liquid solution, which comprises:

a canister having a sidewall, a product chamber member movably mounted within said sidewall and defining at least first and second separate product chambers for containing liquids to be dispensed, first and second pistons mounted in fixed positions within said canister and respectively slidably disposed within said first and second chambers, a manifold mounted within said canister, first and second passages extending from said first and second pistons for feeding to said manifold liquids displaced from said first and second chambers, means for moving said chamber member over said pistons to displace liquids from said chambers through said passages to said manifold, in which said liquids are mixed, and an applicator mounted on said canister and coupled to said manifold for dispensing liquids displaced from said chambers through said manifold.

2. The package set forth in claim 1 wherein said first and second pistons are respectively suspended from said manifold by said first and second passages.

3. The package set forth in claim 2 wherein said manifold has an outlet coupled to said applicator and a pair of spaced parallel inlets from which said first and second pistons are respectively suspended by said first and second passages.

4. The package set forth in claim 3 wherein said manifold is suspended from said applicator.

5. The package set forth in claim 3 wherein said first and second passages are respectively integrally formed with said first and second pistons and extend through said pistons to said first and second chambers.

6. The package set forth in claim 5 wherein said first piston and first passage are molded separately from said second piston and said second passage.

7. The package set forth in claim 5 wherein said first and second pistons and associated passages are of integrally formed plastic construction.

8. The package set forth in claim 5 wherein each of said pistons has a peripheral seal in sliding sealing engagement with an inside surface of the associated chamber.

9. The package set forth in claim 1 wherein each said chamber is cup-shaped, having an open end through which the associated piston is received.

10. The package set forth in claim 9 wherein said chamber member, including said first and second chambers, is of integrally formed plastic construction.

11. The package set forth in claim 10 wherein at least one of said first and second chambers, and the associated first and second piston, is of non-cylindrical geometry.

12. The package set forth in claim 11 wherein both of said chambers and the associated pistons are of non-cylindrical geometry.

13. The package set forth in claim 10 wherein said first and second chambers, and said associated first and second pistons, have unequal cross sectional areas perpendicular to the direction of movement of said chamber member within said canister.

14. The package set forth in claim 10 wherein said chamber member has external guides that cooperate with internal guides on said canister sidewall for guiding movement of said chamber member within said canister.

15. The package set forth in claim 1 wherein said means for moving said chamber member comprises a threaded collar on said chamber member, a threaded screw rotatably carried by said canister, said collar and screw having mating threads, and means for rotating said screw with respect to said canister to move said chamber member within said canister.

16. The package set forth in claim 15 wherein said collar is internally threaded, and said screw is externally threaded and received in said collar.

17. The package set forth in claim 16 wherein said screw has a base rotatably supported by said canister, and said means for rotating said screw comprises means for rotating said base.

18. The package set forth in claim 17 wherein said canister has a pedestal on which said base is supported, and wherein said base and said pedestal have opposing means for permitting rotation of said screw in one direction to raise said chamber member over said pistons and to prevent rotation of said screw in an opposing direction.

19. The package set forth in claim 18 wherein said pedestal has an opening, and said screw base has a split lug received through said opening to secure said screw to said pedestal.

20. The package set forth in claim 19 wherein said means for rotating said base comprises a button carried by said canister adjacent to said screw base.

21. The package set forth in claim 20 wherein said screw base has external rachet teeth, and said button has a pawl arm for engaging said rachet teeth.

22. The package set forth in claim 21 wherein said canister sidewall has an opening adjacent to said screw base, and said button is pivotally mounted within said sidewall with a portion extending through said opening for manipulation by a user.

23. The package set forth in claim 22 where said button has a center pivot coupled to said canister, a resilient arm extending from said pivot on which said button and said pawl arm are mounted, and a support arm extending oppositely from said pivot to bias said button through said opening.

24. The package set forth in claim 1 wherein said means for moving said chamber member comprises a gear rack on said chamber member and a gear wheel rotatably carried on said canister sidewall in engagement with said rack for manipulation by a user to move said chamber member within said canister.

25. The package set forth in claim 1 wherein said canister is cup-shaped, having an open end over which said applicator is mounted.

26. A package for containing and dispensing a two-component liquid solution, which comprises:

a canister having a sidewall and an open end, a surface applicator mounted over each open end of said canister, an integrally formed product chamber member movably mounted within said sidewall, said product chamber member including an internally threaded collar and first and second product chamber for containing liquids to be dispensed, a manifold coupled to said applicator within said canister, said manifold having an outlet coupled to said applicator and a pair of spaced parallel inlets, first and second hollow pistons suspended from said inlets and respectively slidably disposed within said first and second chambers, and a screw having an externally threaded shaft received within said collar and a circular base rotatably supported within said canister, rotation of said screw within said canister moving said chamber member over said pistons and displacing liquids from said chambers through said pistons and said manifold to said applicator.

27. The package set forth in claim 26 wherein each of said pistons has a peripheral seal in sliding sealing engagement with an inside surface of the associated chamber.

28. The package set forth in claim 26 wherein each said chamber is cup-shaped, having an open end through which the associated piston is received.

29. The package set forth in claim 28 wherein at least one of said first and second chambers, and the associated first and second piston, is of non-cylindrical geometry.

30. The package set forth in claim 29 wherein both of said chambers and the associated pistons are of non-cylindrical geometry.

31. The package set forth in claim 28 wherein said first and second chambers, and said associated first and second pistons, have unequal cross sectional areas perpendicular to the direction of movement of said chamber member within said canister.

32. The package set forth in claim 26 wherein said chamber member has external guides that cooperate with internal guides on said canister sidewall for guiding movement of said chamber member within said canisters.

33. The package set forth in claim 26 wherein said canister has a pedestal on which said base is supported, and wherein said base and said pedestal have opposing means for permitting rotation of said screw in one direction to raise said chamber member over said pistons and to prevent rotation of said screw in an opposing direction.

34. The package set forth in claim 33 wherein said pedestal has an opening, and said screw base has a split lug received through said opening to secure said screw to said pedestal.

35. The package set forth in claim 33 further comprising a button carried by said canister adjacent to said screw base for rotating said screw base and displacing said chamber member over said pistons.

36. The package set forth in claim 35 wherein said screw base has external rachet teeth, and said button has a pawl arm for engaging said rachet teeth.

37. The package set forth in claim 36 wherein said canister sidewall has an opening adjacent to said screw base, and said button is pivotally mounted within said sidewall with a portion extending through said opening for manipulation by a user.

38. The package set forth in claim 37 wherein said button has a center pivot coupled to said canister, a resilient arm extending from said pivot on which said butt on and said pawl arm are mounted, and a support arm extending oppositely from said pivot to bias said button through said opening.

39. A package for containing and dispensing a two-component liquid solution, which comprises:

a canister having a sidewall and an open end, a surface applicator mounted over said open end of said canister, an integrally formed product chamber member movably mounted within said sidewall, said product chamber member including a gear rack and first and second product chambers for containing liquids to be dispensed, a manifold coupled to said applicator within said canister, said manifold having an outlet coupled to said applicator and a pair of spaced parallel inlets, first and second hollow pistons suspended from said manifold inlets, and respectively slidably disposed within said first and second chambers, and a gear wheel rotatably carried by said canister sidewall in engagement with said rack for manipulation by a user to move said chamber member over said pistons.

40. The package set forth in claim 39 wherein each of said pistons has a peripheral seal in sliding sealing engagement with an inside surface of the associated chamber.

41. The package set forth in claim 39 wherein each said chamber is cup-shaped, having an open end through which the associated piston is received.

42. The package set forth in claim 41 wherein at least one of said first and second chambers, and the associated first and second piston, is of non-cylindrical geometry.

43. The package set forth in claim 42 wherein both of said chambers and the associated pistons are of non-cylindrical geometry.

44. The package set forth in claim 39 wherein said first and second chambers, and said associated first and second pistons, have unequal cross sectional areas perpendicular to the direction of movement of said chamber member within said canister.

45. A method of making a package for containing and dispensing a multiple-component liquid solution, which comprises the steps of:

(a) providing a canister having an open end and a sidewall, (b) mounting within said canister an integrally molded product chamber member having at least first and second product chambers and first means for moving said member with respect to said sidewall, (c) mounting within said canister second means for engagement with said first means and manipulation by a user to move said member within said canister, (d) providing a surface applicator, (e) suspending from said applicator at least first and second hollow pistons, (f) filling said first and second chambers with first and second liquids to be dispensed, and (g) assembling said surface applicator over said open end of said canister such that said first and second pistons are respectively disposed in said first and second chambers.

46. A package for containing and dispensing a multiple-component liquid solution, which comprises:

a canister having a sidewall and an open end, a surface applicator mounted over said open end, an integrally formed product chamber member movably mounted within said sidewall, said product chamber member including at least first and second cup-shaped product chambers having open ends adjacent to each other, and first means for moving said member with respect to said sidewall, a manifold coupled to said applicator within said canister, said manifold having at least first and second parallel inlets, first and second hollow pistons respectively suspended from said first and second manifold inlets and respectively slidably disposed within said first and second chambers, and second means on said canister in engagement with said first means for manipulation by a user to move said chamber member over said pistons and displace liquid from said chambers through said pistons and said manifold to said applicator.

47. The package set forth in claim 46 wherein said first means comprises an internally threaded collar in said chamber member, and said second means comprises an externally threaded screw.

48. The package set forth in claim 46 wherein said first means comprises a gear rack on said chamber member, and said second means comprises a gear wheel on said canister sidewall.

* * * * *